United States Patent [19]

Keeffe et al.

[11] 4,302,699

[45] Nov. 24, 1981

[54] LOW WATTAGE METAL HALIDE ARC DISCHARGE LAMP HAVING OPTIMUM EFFICACY

[75] Inventors: William M. Keeffe, Rockport; Harold L. Rothwell, Jr., Rowley, both of Mass.

[73] Assignee: GTE Products Corporation, Stamford, Conn.

[21] Appl. No.: 132,932

[22] Filed: Mar. 24, 1980

[51] Int. Cl.[3] ..... H01J 61/18

[52] U.S. Cl. ..... 313/229; 313/217; 313/220; 313/225; 313/227

[58] Field of Search ..... 313/182–187, 313/217, 220, 222–229, 283–286

[56] References Cited

U.S. PATENT DOCUMENTS

| | | | |
|---|---|---|---|
| 3,407,327 | 10/1968 | Koury et al. | 313/229 |
| 4,053,805 | 10/1977 | Scholz et al. | 313/225 X |
| 4,247,798 | 1/1981 | Howe et al. | 313/225 |

*Primary Examiner*—Marvin L. Nussbaum

*Attorney, Agent, or Firm*—James Theodosopoulos

[57] ABSTRACT

A single ended metal halide arc discharge lamp contains mercury, sodium halide, scandium, scandium halide and a starting gas. The molar ratio of sodium halide to scandium halide is between about 5 to 8 in order to obtain optimum luminous efficacy.

5 Claims, 2 Drawing Figures

LOW WATTAGE METAL HALIDE ARC DISCHARGE LAMP HAVING OPTIMUM EFFICACY

DESCRIPTION

1. Technical Field

This invention is concerned with high pressure metal halide arc discharge lamps. Such lamps generally comprise a fused guartz envelope containing a fill including mercury, metal halide and a starting gas. The invention is particularly concerned with such lamps containing scandium.

2. Background Art

Background art for high pressure metal halide arc discharge lamps is shown in U.S. Pat. No. 3,761,758 and the patents listed therein. Said patents disclose lamps having a double-ended arc tube, that is to say, an elongated arc tube having an electrode at each end. Our invention is particularly concerned with low wattage scandium-containing metal halide lamps; such lamps are discussed in U.S. Pat. No. 4,161,672 which also discloses the use of double-ended arc tubes therefor. Scandium-containing metal halide arc discharge lamps are also disclosed in U.S. Pat. Nos. 3,351,798, 3,407,327, 3,577,029, 3,911,308 and 3,979,624.

DISCLOSURE OF INVENTION

A low wattage metal halide arc discharge lamp in accordance with this invention has a single-ended arc tube, that is to say, an arc tube having a press seal only at one end thereof, with two main electrodes in the press seal. The lamp contains a filling including a starting gas, mercury, scandium and sodium halide. During lamp operation, some of the scandium is in halide form in the arc tube.

We have found that in order to obtain optimum luminous efficacy from such a lamp, the molar ratio of sodium halide to scandium halide should be between about 5 to 8. This is surprising since U.S. Pat. No. 3,979,624 discloses that optimum efficacy is obtained when said ratio is between about 1.7 and 5. We believe that the difference may be attributable to the single-ended feature of our arc tube.

In double-ended arc tubes, the electrodes are located at the distal ends thereof, and the arc discharge is said to be wall-stabilized, which is to say that the heat losses involve principally the arc tube wall boundary and its proximity to the electrically conductive arc plasma core, which distance is much less than the spacing between electrodes. In such arcs, heat loss to the electrodes represents a minor element in the overall energy balance of the lamp. However, in our single-ended arc tube, the proximity of the arc plasma to the arc tube wall is about the same order of magnitude as the spacing between electrodes; therefore, heat losses to the electrodes play a significant role in the energy balance of the arc. Under such conditions of partial electrode stabilization, the arc plasma temperature profile would be expected to differ from that of a wall stabilized arc. This may account for the different ratio that yields optimum efficacy.

DESCRIPTION OF PREFERRED EMBODIMENT

Figure 2:
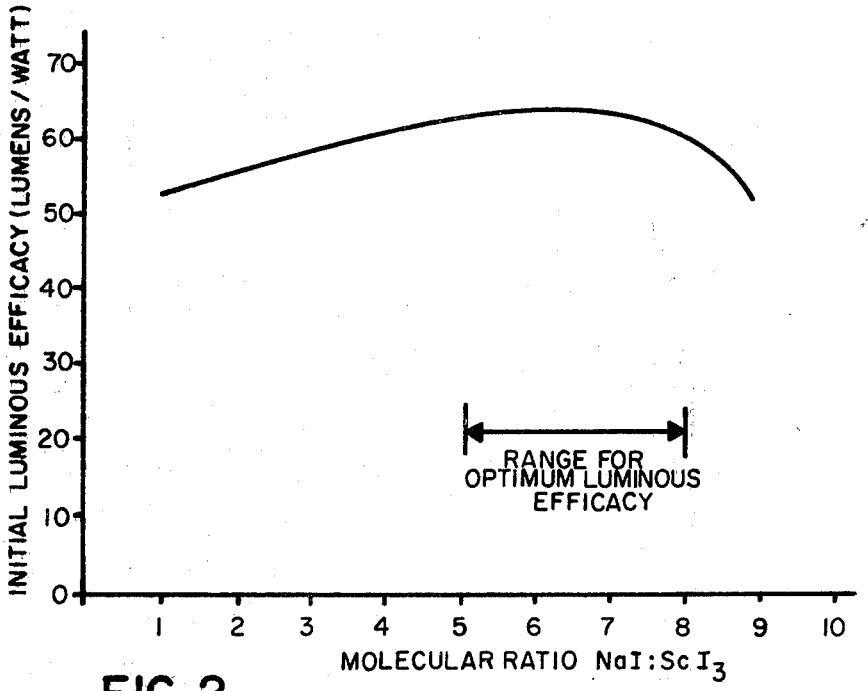
FIG. 2 is a curve showing how the initial luminous efficacy of such a lamp varies with the molecular ratio of sodium iodide to scandium iodide.

In a preferred embodiment, a low wattage metal halide arc discharge lamp in accordance with this invention comprises an arc tube 1 made, for example, of fused quartz, having a press seal 2 at one end thereof. Electrodes 3, which extend into arc tube 1, are connected to molybdenum ribbons 4, which are embedded in press seal 2. Ribbons 4 are connected to external lead-in wires 5. There is an exhaust tube tip-off 6 on arc tube 1 opposite press seal 2. Arc tube 1 contains, during normal operation, mercury, sodium halide, scandium, scandium halide and a starting gas. The ratio of sodium halide to scandium halide in the arc tube is between about 5 to 8, as shown in FIG. 2, in order to yield optimum luminous efficacy.

Figure 1:
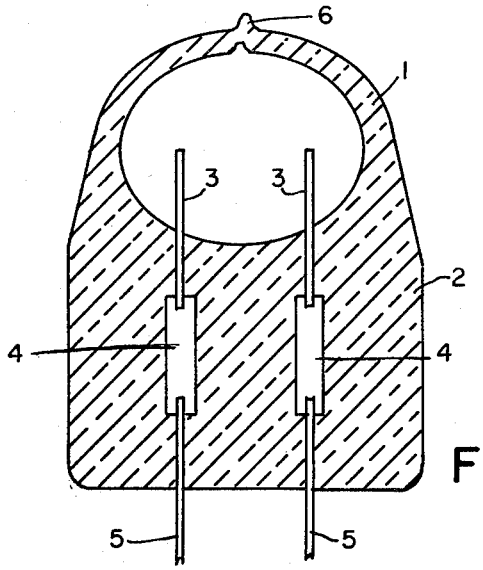
FIG. 1 is a sectional view of a low wattage single-ended metal halide arc discharge lamp in accordance with this invention.

In a specific example, arc tube 1 was tube 1 was made from T3 fused quartz tubing (7.4 mm inside diameter) and had a shape that was somewhat ovoid in the plane shown in FIG. 1 and somewhat spherical in the plane orthogonal thereto between electrodes 3. Electrodes 3 were made of 20 mil diameter thoriated tungsten rods. Molybdenum ribbons 4 were 89 mils wide lead-in wires 5 were made of 30 mil diameter molybdenum wires. The spacing between electrodes 3 was 3.1 mm.

The arc tube contained an initial filling of 9.1 mg mercury, 0.65 mg mercuric iodide, 1.0 mg (6.7 micromoles) sodium iodide, 0.2 mg (4.4 micro-gram-atoms) scandium metal and argon at 200 torr. During the first hours of lamp operation, the iodine in the mercuric iodide reacted with the scandium to form $ScI_3$, leaving free scandium metal in the arc tube, which is necessary for purposes of this invention. At the time the 100 hour luminous flux was measured, the reaction between the mercuric iodide and the scandium was substantially complete, and the molar ratio of sodium iodide to scandium iodide was 7.1, which is determined as follows. The 0.65 mg of $HgI_2$ contains 2.8 micro-gram-atoms of iodine, which react with 0.94 micro-gram-atoms of scandium to yield 0.94 micro-moles of $ScI_3$. The ratio of 6.7 micro-moles of sodium iodide to 0.94 micro-moles of scandium iodide is 7.1. The excess scandium is equivalent to 4.4 minus 0.94, or 3.46 micro-gram-atoms.

The luminous flux from the lamp, at initial operation at 53 volts, 0.873 amperes was 3010 lumens, giving an initial luminous efficacy of 65 lumens per watt. The 100 hour luminous flux was 2440 lumens at 64 volts, 0.766 amperes, giving an efficacy of 49.8 lumens per watt.

We claim:

1. A single-ended low wattage metal halide arc discharge lamp comprising: an arc tube having a press seal at one end thereof, two main electrodes embedded in the press seal and extending into the arc tube, the arc tube containing mercury, sodium halide, scandium, scandium halide and a starting gas, the molar ratio of sodium halide to scandium halide during normal operation being between about 5 to 8 in order to obtain optimum luminous efficacy.

2. The lamp of claim 1 wherein the fill initially added to the arc tube included mercuric iodide and scandium metal.

3. The lamp of claim 2 wherein the amount of said scandium metal was in excess of that amount needed to react with all the iodine in said mercuric iodide to form $ScI_3$.

4. A single-ended low wattage metal halide arc discharge lamp comprising: an arc tube having a press seal at one end thereof, two main electrodes embedded in the press seal and extending into the arc tube, the arc tube containing an initial filling that includes mercury, sodium halide, scandium, a starting gas and a metal halide that reacts with scandium to form scandium halide, the reaction of said metal halide with scandium being substantially complete after about 100 hours of lamp operation, the molar ratio of sodium halide to scandium halide being between about 5 to 8 after said substantially complete reaction, there remaining elemental scandium in the arc tube after said substantially complete reaction.

5. The lamp of claim 4 wherein said metal halide is mercuric iodide.

* * * * *